United States Patent [19]

Levasseur

[11] 4,429,778

[45] Feb. 7, 1984

[54] CONDITIONING TIME CONTROL FOR VENDING BY SELECTION

[75] Inventor: Joseph L. Levasseur, Chesterfield, Mo.

[73] Assignee: H. R. Electronics Company, St. Louis, Mo.

[21] Appl. No.: 283,656

[22] Filed: Jul. 15, 1981

[51] Int. Cl.[3] ..... G07F 5/16

[52] U.S. Cl. ..... 194/10; 221/15; 194/9 T

[58] Field of Search ..... 194/2, 10, 9 T; 221/9, 221/13, 15, 21, 150, 129

[56] References Cited

U.S. PATENT DOCUMENTS

| | | | |
|---|---|---|---|
| 2,564,552 | 8/1951 | Verdery, Jr. | 194/10 |
| 3,620,341 | 11/1971 | Gardner | 194/10 |
| 4,030,632 | 6/1977 | Harashima | 194/2 |
| 4,359,147 | 11/1982 | Levasseur | 221/15 |

*Primary Examiner*—Stanley H. Tollberg
*Attorney, Agent, or Firm*—Haverstock, Garrett & Roberts

[57] ABSTRACT

A conditioning time control and method of operation thereof for controlling the pre-vend conditioning of products in a multi-selection vendor having credit entry circuitry, vend selection switches, each vend selection having a pre-established vend price associated therewith, product conditioning circuitry, and vend producing circuitry responsive to actuation of a vend selection switch for effecting delivery of a selected product to the customer when the credit entered is at least equal to the vend price for the selected product, the conditioning time control including circuitry to inhibit vending of the product associated with a particular vend selection for a period of time to permit preconditioning of such product, conditioning selection switches operable by authorized personnel for individually establishing the particular selections to be inhibited, and a reset switch operable by authorized personnel, the inhibiting circuitry being responsive to actuations of the conditioning selection switches and to operation of the reset switch to effect preconditioning of the products associated with the actuated conditioning selection switches by inhibiting vending of such products for a period of time subsequent to operation of the reset switch while permitting vending of others of the vend selections when selected by a customer.

30 Claims, 3 Drawing Figures

CONDITIONING TIME CONTROL FOR VENDING BY SELECTION

The present invention relates to a conditioning time control for vending by selection, and, more specifically, to a control circuit for controlling the conditioning, such as precooling, of selected products in a multi-selection vending machine.

Many vending machines are employed to vend food and beverages of various types. Typical of such vending machines are beverage machines, especially beverage machines of the type that dispense one or more types of bottled or canned soda. With machines of this type, it is frequently the case that when the serviceman services a machine he finds that one type of soda has been sold out while there still remain other types of soda that have not been sold, or that all of one column of a particular type of soda is empty while other columns remain full or at least partially full. In restocking the machine it is generally the case then that the service man would be inserting unchilled bottles or cans into the vending machine. If an entire column had been empty this would mean that all the bottles or cans placed in that column would be unchilled and, if the customer were permitted to make a selection from that column immediately after servicing of the machine, he would obtain warm soda. This is generally not desired by the customer, and, in some cases, the customer, in anger and frustration over having received a warm soda, attempts to damage the vending machine. This is obviously an undesirable situation.

One method employed to try to avoid the occurrence of such a situation has been to retain or attempt to retain a cold can reserve in each product column, such as by displaying a "sold out" indication for a particular column whenever the number of chilled cans therein falls below some predetermined number. There are obvious disadvantages with such method. If no further sales from such column are permitted despite the presence of chilled cans therein, sales may be lost, vendor capacity is reduced by the number of cans that must be held in reserve, and more frequent servicing may be required. Furthermore, if demand should be high immediately after servicing, the chilled cans reserved from prior to servicing could still be rapidly depleted before the restocked cans are chilled, and a customer might still receive warm soda.

Another method that overcomes some of these problems would be to discourage sales from particular columns when the number of cans therein fall below some level, such as by displaying a "make another selection" indication, but by continuing to vend chilled cans from the reserve if the customer still makes that selection. However, with this method part or all of the reserve could be depleted, with the consequence that fewer chilled cans might remain after servicing than would remain under the formerly described method, thereby increasing the likelihood of warm soda being vended after servicing of the vendor.

The present invention overcomes these various problems by providing control means for allowing vending from columns containing a sufficient number of chilled cans while inhibiting vending from columns that contain unchilled, or an insufficient number of chilled, cans for a long enough time to permit such unchilled cans to be chilled. The control system of the present invention is most easily described in terms of an improvement over the devices disclosed in Levasseur U.S. Pat. No. 4,359,147 which issued Nov. 16, 1982, and Levasseur U.S. Pat. No. 3,894,220 which issued July 8, 1975, both of which are assigned to Applicant's assignee. It is to be understood, however, that the subject invention can also be used in conjunction with other vend control systems and circuits and is not limited to use with any particular circuit or system. Typical of other control systems with which the present improvement can be used are the vending control devices disclosed in U.S. Pat. Nos. 3,687,255 and 4,008,792, also assigned to Applicant's assignee. It can also be used with vendors and vend selections which, instead of chilling, require heating or other preconditioning operations.

The present invention thus relates to a vending control means, and a method of operation thereof, for a multi-selection vendor having means for entering credit, means for entering a selected vend selection having a preestablished vend price, and vend producing means responsive to entry of such selected vend selection and vend price when credit at least equal to such vend price has been deposited to effect delivery of a product to the customer, and it includes means for inhibiting vending of the product associated with a particular selection for a period of time, means operable by authorized personnel for establishing the particular selection to be inhibited, and reset means operable by authorized personnel, the inhibiting means being responsive to operation of the reset means and to operations of said means for establishing the particular selection to be inhibited to inhibit vending of the product associated therewith for a period of time subsequent to operation of the reset means while permitting vending of others of the vend selections when selected by a customer. Such invention is adaptable for use either in conventional hardware oriented vending control systems or in the microprocessor controlled systems that are becoming increasinly prevalent, and thus provides a versatile, yet economical, means and method of time conditioning selected vend selections of a multi-selection vendor and for controlling such time conditioning.

It is therefore a principal object of the present invention to teach the construction and operation of a conditioning time control for a multi-selection vendor, and particularly, a control for time conditioning less than all selections of the multi-selection vendor.

Another object is to provide a vending control system that reduces or eliminates the vending of unconditioned selections.

Another object is to minimize the extent to or time for which a multi-selection vending machine must be removed from service after re-stocking to permit the proper conditioning of the re-stocked products.

Still another object is to provide a multi-selection vendor which permits vending of properly conditioned selections immediately after servicing while inhibiting vending of improperly conditioned or unconditioned selections until such time as they have been conditioned.

Another object is to teach the construction and operation of a time control means for conditioning selected vend selections.

Another object is to give the customer of a vending machine the option of choosing an alternate product when a chosen product is not properly conditioned for vending.

These and other objects and advantages of the present invention will become apparent after considering the following detailed specification in conjunction with the accompanying drawings, wherein.

Figure 1:
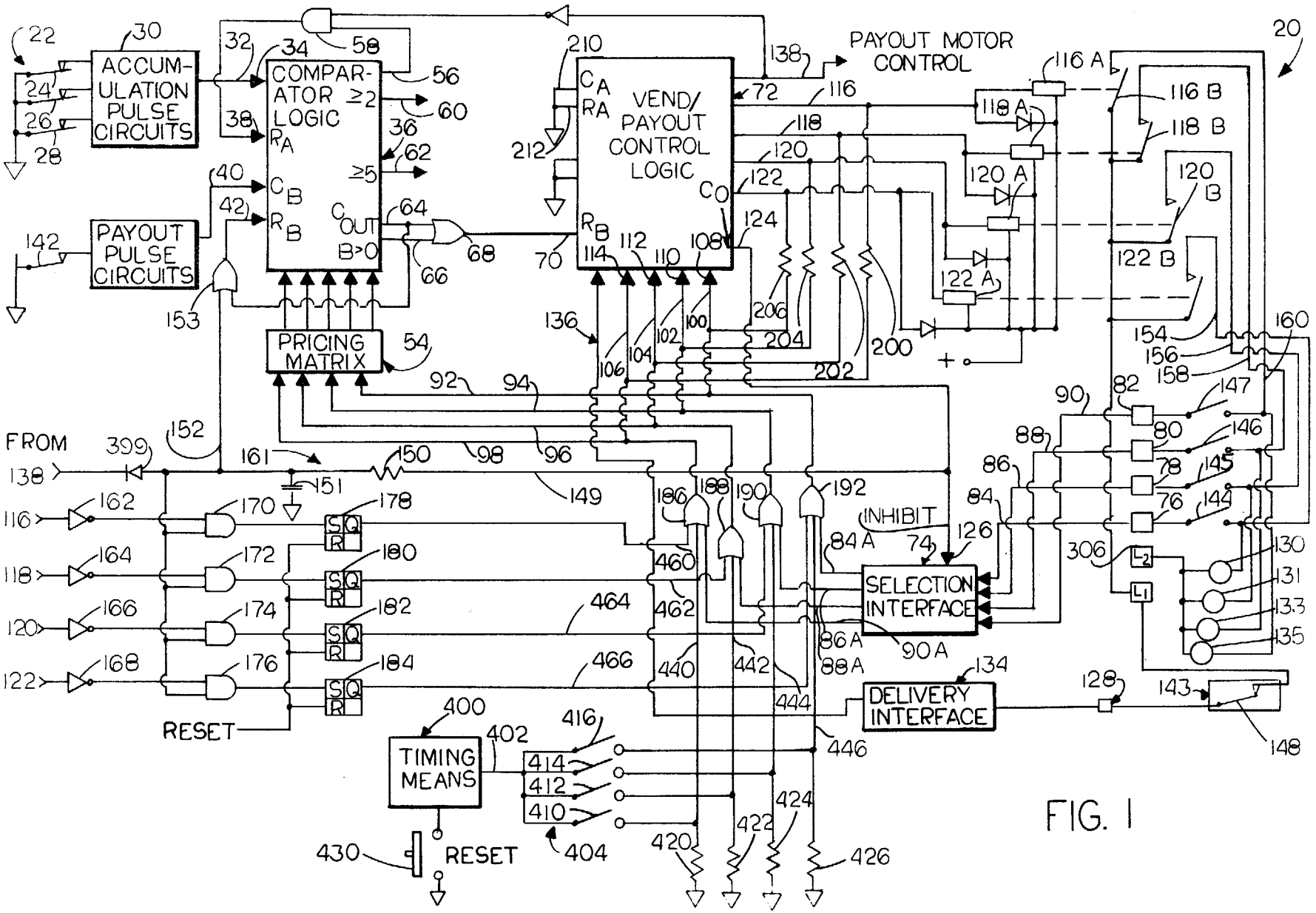
FIG. 1 is a circuit diagram, partly in block form, showing the more important components and their interconnections in a vend control circuit that embodies the teachings of the present invention.

Referring to the drawings more particularly by reference numbers, number 20 in FIG. 1 refers to a vend control circuit incorporating the teachings of the present invention. FIG. 1 is similar in many respects to FIG. 2 of Levasseur U.S. Pat. No. 4,359,147 and to FIG. 1 of U.S. Pat. No. 3,894,220, in all of which figures like numbers refer to like components, and the description of the noted figures in the referenced application and patent are incorporated herein by reference. The referenced application and patent are both assigned to Applicant's assignee.

Figure 2:
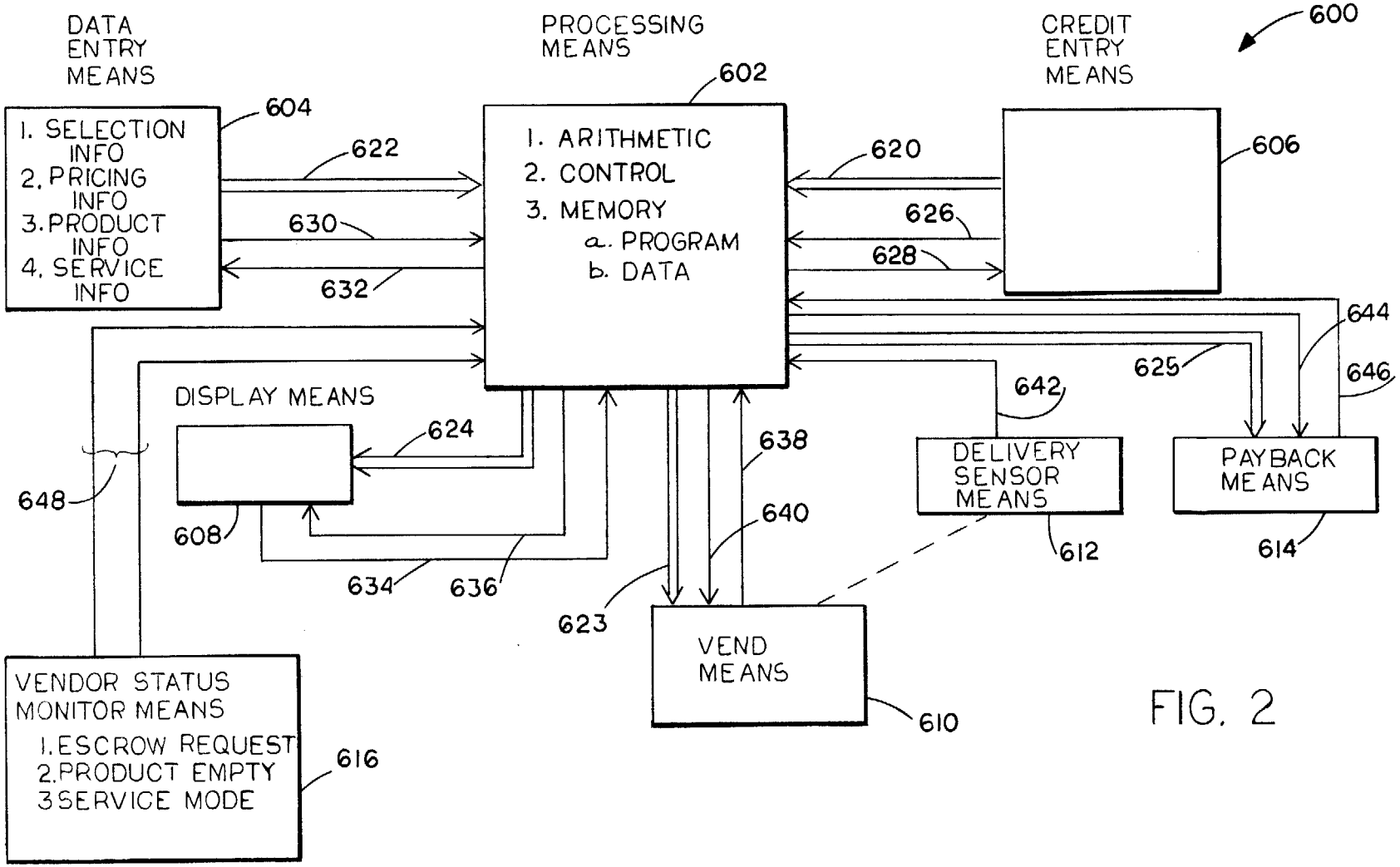
FIG. 2 is an alternate embodiment of the subject invention, employing a microprocessor.

FIG. 1 also includes features not disclosed in either FIG. 2 of U.S. Pat. No. 4,359,147 or FIG. 1 of U.S. Pat. No. 3,894,220. In particular, among other additional features, FIG. 1 includes a timing means 400, having an output 402 connected to a switch bank 404 including switches 410, 412, 414, and 416, which switches are related, respectively, to selection switches 147, 146, 145 and 144. Closure of a switch 410, 412, 414, or 416 applies the output from the timing means 400 across a respective pull-up resistor 420, 422, 424, or 426 and supplies the resulting voltage thereacross as an input on the respective input lead 440, 442, 444, or 446 to a respective OR gate 186, 188, 190, or 192. A normally open re-set switch 430 is provided and connected to timing means 400 to cause the re-setting thereof upon closure of the switch 430. The importance and operation of such circuitry with respect to the present invention will be more fully realized as a result of the explanation which follows.

With the embodiment depicted in FIG. 1, if the various product selection columns of the vending machine with which the vend control circuit 20 is employed are all sufficiently full, the products therein are all properly conditioned, and the customer, after making adequate deposit, actuates one of the selection switches 144–147, he completes a circuit through a respective vend motor 130, 131, 133, or 135, which circuit completion is detected by the selection interface 74, one embodiment of which is that depicted in FIG. 17 of U.S. Pat. No. 3,894,220 and described therein. It will be recognized, however, that numerous other embodiments of selection interface or monitor circuits could be employed, including circuits such as those described in U.S. Pat. No. 3,828,903, also assigned to Applicant's assignee. With the selection interface embodiment of FIG. 17 of U.S. Pat. No. 3,894,220 the selection interface 74 would be responsive to completion of a circuit through one of the leads 84, 86, 88, or 90 to effect generation of a low output from the selection interface on a respective lead 84A, 86A, 88A, or 90A to respective OR gate 192, 190, 188, or 186 to produce a low on both the respective pricing lead 92, 94, 96, or 98 to the pricing matrix 54 and the respective direct set input 100, 102, 104, or 106 of the vend/payout control logic circuit 72.

The resulting low on a pricing lead 92, 94, 96, or 98 causes the pricing matrix 54 to feed the correct vend price for the selection made to the B or price side of the comparator circuit 36, thereby causing both B>O lead 66 and Cout lead 64 to go low (since adequate deposit was made). The effect of this action is to remove the high signal on reset input 70 to vend/payout control logic circuit 72, thus permitting the previously generated low on the appropriate direct set input 100, 102, 104, or 106 thereof to effect the making of an entry into the vend/payout control logic circuit 72. The effect of such entry is to produce a low output on lead 124 and on a corresponding lead 116, 118, 120, or 122, the latter of which causes the respective vend relay 116A, 118A, 120A, or 122A to be energized, all as has been explained in U.S. Pat. No. 4,359,147 and U.S. Pat. No. 3,894,220. When the desired vend relay is thus energized it causes appropriate contact 116B, 118B, 120B, or 122B to close to establish a circuit through the respective lead 160, 158, 156, or 154 to energize the respective vend delivery motor 135, 133, 131, or 130. Meanwhile, the low output produced on lead 124 of circuit 72 is communicated to input terminal 126 of selection interface 74 to inhibit further operation of the selection interface 74 and to prevent the recognition of further selections at this time, and it is also provided via lead 149 to start the timer circuit 161 to initiate a predetermined time period of long enough duration to assure that the selected vend delivery will have time to be completed.

If, during the predetermined time period established by the values of the resistor 150 and the capacitor 151 in the timer circuit 161, a product is in fact delivered so that the normally closed contacts 148 of the sensor device 143 open, then in due course a signal is applied through the delivery interface 134 to the direct set input 136 of the vend/payout control logic circuit 72 to effect initiation of a payout operation, if necessary, and termination of the vend cycle. As explained in U.S. Pat. No. 3,894,220, receipt of the low signal on direct set input 136 causes the output on lead 138 from the vend/payout control logic circuit 72 to go low, thereby effecting change-making until such time as output 56 from the comparator circuit 36 also goes high indicating that change-making has been completed, at which time reset input 38 to the comparator circuit 36 is caused to go high to effect reset of the A register in comparator circuit 36. As a result of such resetting of the A register, Cout output on lead 64 will be caused to go high and this high will be gated through OR gate 68 to reset input 70 of vend/payout control logic circuit 72 and through OR gate 153 to reset input 42 of comparator circuit 36 to effect the resetting of the B register thereof to terminate the vending operation in progress and to condition the vend control circuitry for subsequent vending operations.

When the output 138 of the vend/payout control logic circuit 72 is caused to go low following receipt of a signal on the direct set input 136, it is known that vend delivery has occurred, and at such point in time it is desirable to ensure that the operation of the timer 161 will have no untoward effect upon completion of a normal vending operation cycle. This is accomplished by means of diode 399 connected between leads 138 and 152 which couples the low signal generated on output lead 138 of vend/payout control logic circuit 72 to lead 52 to disable the timer 161 by causing a low signal to be applied and maintained on the lead 152 to OR gate 153, thereby preventing the timer 161 from producing a high signal on lead 152 that would cause reset, perhaps before completion of necessary change-making operations, of the B register of comparator circuit 36. Resetting of the B register of the comparator circuit 36 due to the timing out of the timer circuit 161, as will be explained, effects termination of the vending operation in progress, and, it is thus desirable to provide that, if proper vend delivery has occurred, the vending operation not be terminated prior to completion of all necessary change-making operations. Such is the purpose of diode 399.

If, instead of the above-described operation, a vend operation were initiated in a like manner so that a selected vend motor is energized and cycles, and a predetermined time interval is commenced, but no vend delivery occurs, such as because the product selection chosen by the customer is sold out, the contacts of the sensor switch 148 would not open and no low signal would be applied to the direct set input 136 of the vend-/payout control logic circuit 72. Consequently, lead 138 therefrom would remain high and the timer 161 would not be disabled. Instead, timing out of the timer 161 would result in generation of a high signal on input lead 152 to OR gate 153 and the application of the output from such gate 153 as a reset signal on the reset input 42 of the comparator circuit 36. As has been explained in U.S. Pat. No. 4,359,147, such circuitry effects termination of the vending operation then in progress, prevents the customer from losing the vend price from the amount of his deposit when, for some reason, a vend was initiated as a result of which no product delivered, and permits him to make an alternate selection or to obtain a refund of his deposit, whichever is desired.

The outputs 116, 118, 120 and 122 of the vend/payout control logic circuit 72, which outputs are connected to energize the respective vend relays 116A,B; 118A,B; 120A,B; and 122A,B, as already described, are also connected respectively to inputs of inverters 162, 164, 166 and 168. The inverters 162, 164, 166, and 168 have their outputs connected respectively to inputs of AND gates 170, 172, 174, and 176, and the outputs of the AND gates 170, 172, 174, and 176 are connected respectively to SET inputs of flip-flops 178, 180, 182, and 184. The AND gates 170, 172, 174, and 176 also have other inputs that are connected in common to the lead 152 on the output side of the timer circuit 161. The Q outputs of of the flip-flops 178, 180, 182, and 184 are, in turn, connected through leads 460, 462, 464, and 466, respectively, to inputs of OR gates 186, 188, 190, and 192, other inputs of which, as explained, are connected to respective outputs of the selection interface circuit 74, and the outputs of such OR gates are connected as inputs to the pricing matrix 54 and to the direct set inputs to the vend/payout control logic circuit 72.

The purpose of this last-discussed circuit is to prevent the customer from making further selections of a product that, for some reason, has failed to deliver when selected. When a particular vend selection is selected at a time when an amount at least equal to the vend price for that selection has been deposited, a low output will be produced on one of the respective vend control lines 116, 118, 120, or 122 to activate the corresponding respective vend relay 116A,B; 118A,B; 120A,B; or 122A,B, and such output will also be provided, after inversion through a respective inverter 162, 164, 166, or 168, to the AND gate 170, 172, 174, or 176 associated with the particular activated vend control line 116, 118, 120 or 122. Thereafter, if the timer 161 times out before delivery is sensed by delivery sensor 143, a high will be produced on lead 152, as has been explained, and will be provided as an input to the gates 170, 172, 174, and 176, the effect of which will be to produce a high output from the gate 170, 172, 174, or 176 associated with the activated vend control line 116, 118, 120, or 122. The occurrence of such an output will operate to cause a respective flip-flop 178, 180, 182, or 184 to be set, and the resulting high output from the appropriate flip-flop 178, 180, 182, or 184 will be provided as an input to a respective OR gate 186, 188, 190, or 192 to prevent a customer from making effective future selections of the product that failed for some reason to deliver.

For example, if vend selection switch 147 were actuated, the vend control system would function as previously described, resulting in production of a low signal on lead 116 and initiation of the timer 161. If the timer 161 thereafter times out prior to delivery sensing by the delivery sensor 143, a resulting high will be produced at lead 152 and provided as one input to AND gate 170, the other input of which results from the low on lead 116 which is inverted by inverter 162, thus effecting a high output from AND gate 170, which causes flip-flop 178 to be set, thereby establishing a high on lead 460 to the OR gate 186. The occurrence of such high condition on an input of OR gate 186 will prevent a low from thereafter occurring at the output of such gate, even if, during subsequent vending operations, selection switch 147 is activated. The flip-flop will remain set until receipt of a reset signal by such flip-flop, the occurrence of which will generally be dependent upon correction of the condition that caused the vend delivery failure, which correction usually requires some action by a repair or service person. Since the vend/payout control logic circuit and the pricing matrix 54 are responsive to the occurrence of low signals on direct set input leads 108, 110, 112, and 114 and the leads 92, 94, 96 and 98, the maintenance of a high state on the output of a respective OR gate 186, 188, 190, or 192, in the manner indicated, will prevent recognition of and attempts to vend a selection that has previously failed to deliver for some reason.

In the embodiment of FIG. 1 each of the OR gates 186, 188, 190, and 192 also includes a further respective input 440, 442, 444, or 446. One or more of such inputs 440, 442, 444, or 446 may be caused to be maintained in a high state for some period of time and to thus prevent recognition of, and attempts to vend, a corresponding selection during the period of time that the appropriate input lead is maintained high. Upon actuation of reset switch 430 timing means 400 is caused to reset and to begin timing out, during the course of which timing out a high signal is present on output lead 402 to the switch bank 404. If a switch 410, 412, 414, or 416 is in an actuated state during timing out of the timing means 400, such actuation will result in application of the signal present on output lead 402 across a respective pull-up resistor 420, 422, 424 or 426 to produce an input signal on a respective lead 440, 442, 444, or 446 to the respective OR gate 186, 188, 190, or 192. For example, if the switch 410 were actuated, the signal present on output lead 402 of the timing means 400 would be applied across resistor 420 to produce an input signal on lead 440 to gate 186, and if such switch were to remain in an actuated state while the timing means 400 was timing out, the high signal output on output lead 402 would be communicated therefrom through closed switch 410 and via lead 440 to gate 186. Due to the presence of a high signal on input lead 440, the output of OR gate 186 would thus be maintained high regardless of the status of the signals on leads 90A and 460 to OR gate 186.

As has already been noted, since the vend/payout logic control circuit 72 and the pricing matrix 54 are responsive, respectively, to the occurrence of low signals on the direct set input leads 108, 110, 112, and 114 and on leads 92, 94, 96, and 98, the maintenance of a high state on the output of a respective OR gate 186, 188, 190, or 192 will thus prevent recognition of, and attempts to vend, a selection corresponding to an actuated switch 410, 412, 414, or 416 so long as the timing means 400 has not timed out. Once the timing means 400 has timed out, however, the output signal on output lead 402 will go low, and this low signal will be coupled through the actuated switch 410, 412, 414, or 416 to the respective input 440, 442, 444, or 446 of the respective OR gate 186, 188, 190, or 192. In such event, the status of the outputs of gates 186, 188, 190, and 192 will then be dependent upon the status of the respective input pairs 90A, 460; 88A, 462; 86A, 464; and 84A, 466, the status of which have been previously discussed and described, so long as flip-flops 178, 180, 182, and 184 remain reset, and future actuations of vend selection switches 144–147 will be recognized and appropriate signals communicated to pricing matrix 54 and vent-/payout control logic 72 regardless of the status of switches 410, 412, 414, and 416.

The result of actuating switches 410 and 430 would thus be to prevent recognition of a selection requested by actuation of the vend selection switch 147 for the time duration as established by the timing means 400. If none of the other switches 412, 414, or 416 were actuated, input leads 442, 444, and 446 to OR gates 186, 188, and 190 would be maintained in a low state due to the grounding of resistors 422, 424, and 426, respectively, and the timing means 400 would have no effect with respect to the recognition or non-recognition of vend selections such as might correspond to selections requested by the actuations of switches 144, 145, or 146. When the timing means 400 times out the output signal on output lead 402 will go low and, with switch 410 still actuated, such low signal will be applied as a low input on lead 440 to OR gate 186, thereby permitting recognition of future actuations of vend selection switch 147 until flip-flop 178 is set by the non-delivery of a product selected by the actuation of vend selection switch 147.

As a consequence of the use of such circuitry in the multi-selection vend embodiment depicted in FIG. 1 it is possible to individually establish a time conditioning period for each vend selection choice depending upon the status of each vend selection choice at the time of vendor servicing. Thus, custom preconditioning of products within the vending machine can be realized. With the circuitry described it is possible to actuate some, but not all, of the switches 410, 412, 414, and 416, depending upon which selections need to be conditioned prior to vending. These selections not requiring conditioning would not have a corresponding switch 410, 412, 414, or 416 actuated and would be vended while selections requiring pre-conditioning would have corresponding switches 410, 412, 414, or 416 actuated and would not be vended during the conditioning period as determined by the timing means 400. The timing means 400 may taken any of numerous forms and the duration of time required for the timing out thereof may be variable and controlled by adjustment means provided therewith to permit adjustment or alteration of the time period thereof.

Although the embodiment of FIG. 1 depicts a single timing means 400 with a single output 402 feeding a switch bank 404 containing four parallel switches, additional timing means could also be provided for one or more of the switches, and, with such an arrangement, different time durations could be established for the conditioning of different products. For example, with a hot/cold beverage dispenser different times might be required to condition the hot beverages than would be required to condition the cold beverages. In addition, in some instances it may be advantageous to provide that the signals generated on leads 440, 442, 444, and 446 are communicated to one or more conditioning means to control the operation thereof, and the means in which this could be accomplished will be readily apparent from FIG. 1. It has also been found desirable to provide visual indications advising the customer of vend selection unavailability whenever a product selection is sold out or undergoing preconditioning. This can be easily accomplished by causing a light associated with the product to light whenever a high signal has been generated on appropriate of the leads 440, 442, 444, or 446. For example, the occurrence of a high signal on either of leads 440 or 460 could effect illumination of a "Make Another Selection" light associated with selection switch 147 and the corresponding product. Numerous other modifications could equally as well be made to effect still further flexibility with the FIG. 1 embodiment. If desired, the switch 430 may be connected such that its closure generates the reset signal to flip flops 178, 180, 182, and 184 as well as to timing means 400.

As has been previously noted, the subject invention is susceptible to use both in the more conventional hardware-oriented vending control system and also in the increasingly prevalent micro-processor controlled systems. FIG. 2 depicts in block form a micro-processor controlled system of the type that may be employed to implement time conditioning of selected products in a multi-selection vending machine. Number 600 refers to the micro-processor controlled vending control system that includes a processing means 602, data entry means 604, credit entry means 606, display means 608, vend means 610, delivery sensor means 612, payback means 614, and vender status monitor means 616. The processing means 602 includes memory means as well as arithmetic and control means typical of a micro-processor controlled vending control system. In the FIG. 2 embodiment credit information may be supplied from the credit entry means 606 to the processing means 602 by means of a data path 620, data information of various types may be provided from the data entry means 604 to the processing means 602 by means of a data path 622, data for vend purposes may be provided to vend means 610 by way of data path 623, information for display may be communicated from the processing means 602 to display means 608 by means of a data path 624, and payback data may be provided to the payback means 614 by way of data path 625. Control and status signals are intercommunicated among the components of the micro-processor control vend control system by means of signal paths 626, 628, 630, 632, 634, 636, 638, 640, 642, 644, 646, and 648.

Figure 3:
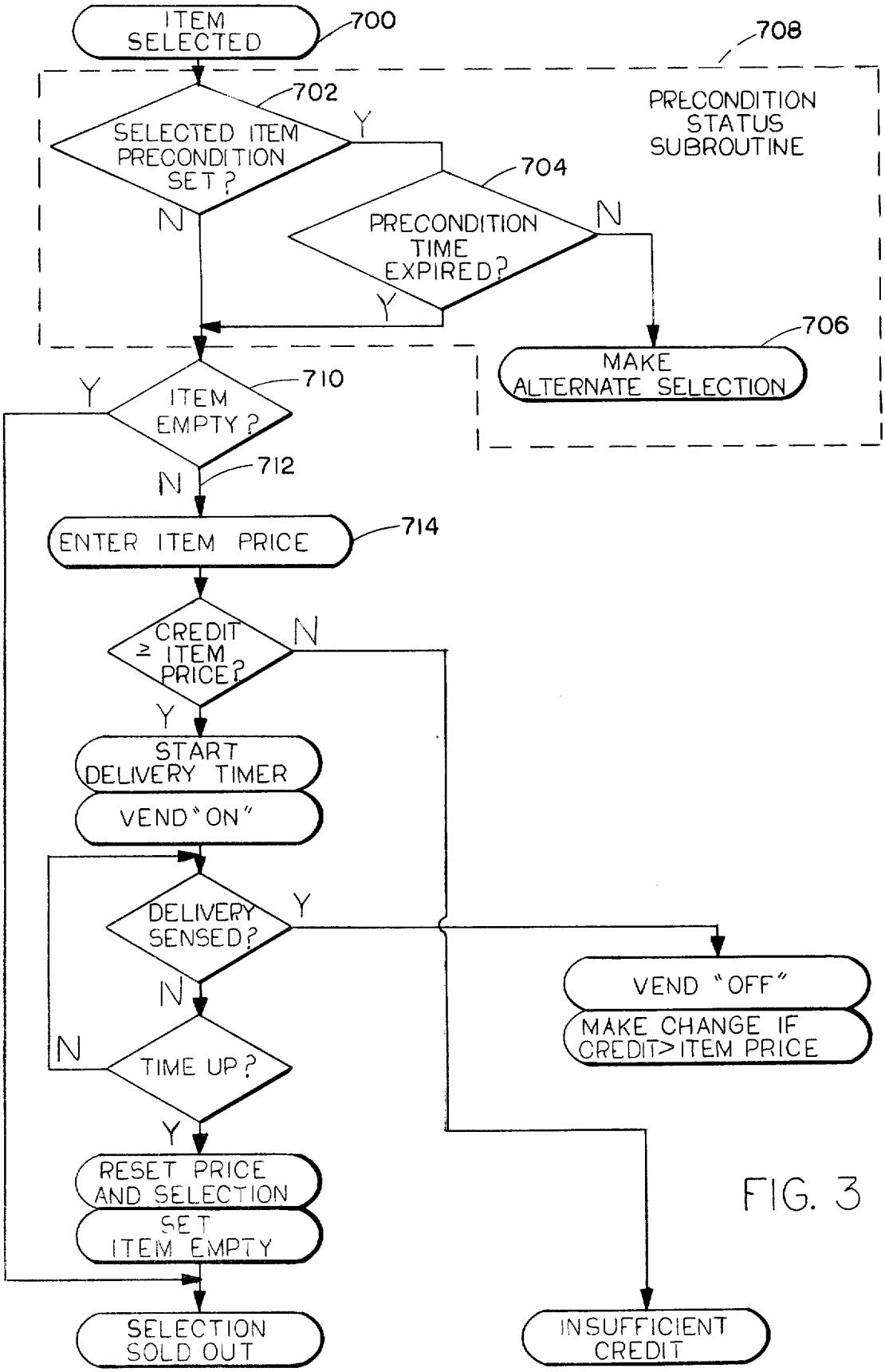
FIG. 3 is an operation sequence chart representative of a portion of the operational sequence of the embodiment of FIG. 2.

FIG. 3 is a functional flow chart presenting, in part a typical sequence of events in the functioning of a micro-processor controlled vending control system such as that depicted in FIG. 2, it being understood that the particular sequence of operation of a micro-processor controlled vending system is controlled by the resident control program, often present as firmware, in the system. It will be appreciated that the sequence of events depicted in FIG. 3 comprises only a portion of a vend cycle of a typical micro-processor controlled vending system and that the program therefor will include and control various other operational steps as well. By way of illustration and for the sake of convenience FIG. 3 is nonetheless useful in explaining the manner in which pre-conditioning can be incorporated into a typical control program.

Referring now to the micro-processor controlled vending control system 600 as it might function under the control of a typical resident control program, such system would normally remain in a standby mode under control of the control means portion of the processing means 602 during periods between vending and/or servicing operations of the system. While in such standby mode the processing means 602 would monitor various status and control inputs from other system elements, such as the status and control input 626 from the credit entry means 606, the status and control input 630 from the data selection means 604, and the status/request leads 648 from the vendor status monitor means, to determine if an external event has occurred which would require the processing means 602 to exit the standby mode and to perform certain operations and/or to control the operation of various other of the system components.

For example, if a customer were to deposit a coin in the coin acceptor of a vending machine, the deposit of such coin would be detected by the credit entry means 606 which would generate an interrupt signal on lead 626 to notify processing means 602 that a coin deposit had occurred. Occurrencwe of the interrupt request on lead 626 would cause the processing means 602, in accordance with the resident control program, to exit the standby mode and enter an interrupt mode to determine the nature of the interrupt request and whether or not such request should be honored at that time. Depending upon the status of the system at the time any interrupt request is received that request may or may not be honored, and this can be controlled by various masking and flagging techniques well known to those skilled in the programming of micro-processor controlled systems.

In the noted instance, recognition of the credit entry interrupt would cause the processing means 602 to enter a credit accumulation subroutine during the course of which the control portion of processing means 602 would act in accordance with the credit accumulation subroutine portion of the program stored within the memory portion of the processing means 602 to receive data provided to the arithmetic portion of processing means 602 via data leads 620 from the credit entry means 606. Depending upon the exact configuration of the vending control system 600 various control signals might be generated during the course of such subroutine and communicated between the processing means 602 and the entry means 606 by way of control leads 628 and 626. Once the credit entry information has been provided to the processing means 602 and accumulated, such credit information may be stored in the data portion of the memory portion of processing means 602. The processing means 602 would then enter an operation idle mode in which, typically, the processing means 602 would refresh data provided to display unit 608 over data path 624 and repetitiously communicate display commands to display means 608 via control lead 636 while awaiting generation of an interrupt request from the data entry means 604, the credit entry means 606, or the vendor status monitor means 616. During most of such operation idle periods the data provided for display will be the total amount of credit accumulated to that point during such vending system operation. Further coin deposits would result in production of interrupt requests from the credit entry means 606 to the processing means 602 in the manner previously indicated, and would cause the processing means 602 to again enter the interrupt mode and, thereafter, to enter the credit accumulation subroutine in the manner already described, the result of which would be an updating of the credit accumulation data and a subsequent return by the vending control system to an operation idle mode.

If, at some point after credit information has been entered, the customer effects entry of selection information into the data entry means 604, an interrupt request is generated on status and control lead 630 causing the processing means 602 to enter the interrupt mode and to examine selection information provided via data path 622 from the data entry means 604 to the processing means 602. Depending upon the particular program employed such examination might require investigation and examination of the information provided on the data path 622 to determine whether or not the entry made is a valid selection code. If the information available is not a valid selection code the customer is advised via the display means 608 or some other form of visual or audio signal that an improper selection code has been entered, and the system returns to an operation idle mode to await further interrupt requests. On the other hand, if the selection code entered is a valid selection code, the processing means enters an "Item Selected" subroutine, such as is depicted as block 700 in FIG. 3, and upon completion thereof, the control portion of processing means 602 proceeds to function in accordance with the resident control program as set forth in the program portion of the memory of processing means 602 in the manner depicted in FIG. 3.

In the typical program being described, following completion of "Item Selected" subroutine 700, the processing enters a "Precondition Status Subroutine" depicted in dotted block 708 and first determines whether the selected item is an item for which preconditioning has been specified. This is depicted by decision block 702 in FIG. 3 wherein the Y, or Yes, path is followed if preconditioning has been specified and the N, or No, path is followed if preconditioning has not been specified. If, during the last servicing of the vending machine by the serviceman, no preconditioning requirement had been established for the particular item that was subsequently selected by the customer, the N path from block 702 would be followed and the program would exit the "Precondition Status Subroutine" and thereafter continue in a manner such as has been previously discussed in U.S. Pat. No. 4,359,147. In the event that preconditioning has been specified for the particular item selected, a further decision is necessary by the processing means 602. As depicted by decision block 704 the control portion of processing means 602 acts in accordance with the sequence of program instructions stored in the memory portion of the processing means to determine if the pre-conditioning time for the selected item has expired. If the preconditioning time for the selected item has not expired by the time the check is made by processing means 602, the N, or No, path is followed from block 704, and the processing means 602 is caused to enter the "Make Alternate Selection" subroutine as denoted by block 706. On the other hand, if the preconditioning time for the selected item has expired by the time of checking, the Y, or Yes, path is followed from block 704, and, as depicted, operation of the micro-processor controlled vending control system proceeds in the manner as previously described in U.S. Pat. No. 4,359,147.

It will be appreciated that certain changes can be made in the operational sequence of events of the micro-processor controlled vending control system without deleteriously affecting the operation of the vending system or negating benefits realized due to preconditioning of certain selected items. For example, the "Precondition Status Subroutine" depicted by the dotted block 708 could be moved from the location between "Item Selected" subroutine block 700 and "Item Empty?" decision block 710 and inserted in the N, or No, path 712 between "Item Empty?" decision block 710 and "Enter Item Price" subroutine block 714. The important factor with respect to preconditioning control in a micro-processor controlled vending control system is determining, subsequent to item selection, but prior to actuation of vend, whether or not the vending of a particular product should be inhibited because of a preconditioning requirement for that item.

Referring again to the micro-processor controlled vending control system depicted in FIG. 2, it will be readily understood by those skilled in the art that when selection information is entered via data means 604 at a time when sufficient credit has been established by the entry of credit from the credit entry means 606, if the product selected is available and not subject to preconditioning at the time of selection, the processing means 602 will cause a control signal to be supplied to vend means 610 via control line 640 to cause the vend means 610 to vend the selected item. Status or control signals may also be supplied by the vend means 610 back to the processing means 602 via control/status line 638. As the selected item is vended such vending will be detected by delivery sensor means 612 resulting in the generation of a control or status signal on control/status line 642 from delivery sensor means 612 to processing means 602. If the credit entry exceeds the price established for the item selected a determination of payback required will be effected by the processing means 602 and control signals communicated via control lead 644 to payback means 614 to effect the return of excess credit entered. Control or status signals may also be supplied from the payback means 614 to processing means 602 by means of control/status lead 646, and the control portion of the processing means 602, in accordance with the program in the memory portion of processing means 602, will function to effect the completion of the vend operation and to cause the vending control system to return to a standby mode of operation pending receipt of subsequent interrupt requests.

While the operation of a micro-processor controlled vending system has thus been generally described for a complete vending operation, it will be appreciated that there are times when, after deposit of coins, the customer decides, for any of numerous reasons, to cancel the vend and to have his money returned to him. This is often permitted at any time prior to the making of a selection by a customer. As has been explained previously, after a credit entry has been made by the customer and the amount of credit has been calculated by the processing means 602 and stored in the data portion of the memory, the sytem, in accordance with the described resident control program, enters an operation idle mode in which it is awaiting generation of further interrupts. If, instead of making a selection, the customer were to activate an escrow switch on the vending machine, the actuation of such escrow switch would result in the generation of a signal from the vendor status monitor means 616 to the processing means 602 via status/request leads 648. The occurrence of such signal prior to recognition of a selection request would typically be recognized as an interrupt request and would cause the processing means 602 to enter the interrupt subroutine to determine the type of interrupt that had occurred. Upon recognition of the escrow request, the processing means would then typically enter an escrow subroutine during the course of which the customer's credit deposits could be returned to him. At the conclusion of such credit refunding, the processing means 602 would return to standby mode to await other interrupt requests.

If selection had been made prior to actuation of the escrow switch, the effect of recognition of the selection request would have been to effectively mask or otherwise prevent the recognition of a subsequent escrow request as a valid interrupt either until the vending operation in progress were completed and the system were returned to a standby mode or until it was otherwise appropriate to again be able to recognize and treat an escrow request. One instance in which it might be desirable to recognize an escrow request after a selection has been made would be when, during the course of the vending operation, it is recognized that the product selected by the customer is unavailable, such as when a product empty signal is communicated to the processing means 602 from vendor status monitor means 616, or a delivery failure occurs, such as would be indicated if a delivery signal were not generated by delivery sensor means 612 and communicated to processing means 602 via lead 642 within a certain time period after actuation of the vend means 610. In either of such cases, viz., product empty or no delivery, the processing means 602 may be programmed to enter the "Make Another Selection" subroutine, during the course of which reconditioning of the vending system would be accomplished, including re-enablement of the escrow request interrupt, following which the processing means 602 would re-enter the operation idle mode to await further interrupt requests, such as an alternate selection request or an escrow request.

In addition to interrupt requests generated by credit entry, by entry of selection information, and by escrow requests, the system may also be designed and programmed to respond to the entry of pricing information, product information, or other service information on an interrupt request basis. In the FIG. 2 embodiment pricing, product, and/or service information may be entered by way of data entry means 604 for communication of an interrupt request via lead 630 to processing means 602. Generally, it is not desirable to permit recognition of interrupts pertaining to entry of pricing, product, or service information once a control system has initiated or entered into a vending operation routine, and this can be readily accomplished by techniques well known to those skilled in the art of micro-processor controlled systems and the programming thereof, such as by various masking and/or flagging techniques. Certain vendor status signals and/or user generated signals might, in many instances, be desirably recognized as valid interrupts only during certain periods of operation of the vending machine, as has already been explained. Typically, interrupt requests indicating entry of pricing, product, or service information will be allowed to be recognized only while the vending control system is in a standby or service mode of operation. It will be readily understood by those skilled in the art how the processing means 602 could be programmed to accomplish such a result.

In the embodiment of FIG. 2 the presence of a service mode signal on status/request leads 648 from the vendor status monitor means 616 to processing means 602 would cause the processing means 602 to enter a service mode of operation. While in such service mode interrupt requests generated by the data entry means 604 and communicated to the processing means 602 via interrupt request line 630 and data path 622 would cause various information stored in the data portion of the memory portion of the processing means 602 to be altered, depending upon the information generated. The ways in which different addresses within the memory portion of the processing means 602 can be addressed and the contents altered by signals generated by the data entry means 604 is well known to those skilled in the art, and any of various techniques and methods for accessing particular memory positions within the memory portion of the processing means 602 and for changing the contents thereof could be employed, including that described in Applicant's U.S. Pat. No. 4,316,532. Consequently, during a service mode of operation, it would be a relatively simple matter to make an entry into an appropriate memory address to effect a change in the price of a product, to effect a change in the component throw of a product, or to indicate that, for a particular product selection, time conditioning for some specified period of time is required prior to the vending of such product. When the service mode is then exited, such as in response to a change in the service mode signal on status/request leads 648 from vendor status monitor means 616, and the vending control system is returned to its standby mode, vend operations will thereafter proceed under control of the control portion of the processing means 602 in accordance with the program and the new data stored in the memory thereof, and precondition checking utilizing the new data entered during the servicing will occur in a manner such as is depicted in FIG. 3, including the "Precondition Status Subroutine" 708.

Although it will thus be apparent how the embodiment of FIG. 2 and the flow chart depicted in FIG. 3 are related to one another, it will also be recognized that the operation of various micro-processor controlled vending systems may vary somewhat depending upon the various peripheral system components utilized and the particular program employed. For example, with some systems, it may be more desirable to cause various activities to set flags instead of generating interrupt requests, and to have the flags periodically checked by the resident control program during the course of operation of the vending control system. In such an event there could be a flag associated with each permissible product selection, the setting of which flag would indicate that time conditioning for the associated product is required. Upon the conclusion of the requisite time period for time conditioning, the flag could be cleared. As with the FIG. 3 flow chart, however, the precondition status check would still be required to take place subsequent to item selection and prior to actuation of vend, as has been previously discussed.

There has thus been shown and described a conditioning time control for vending by selection which fulfills the various objects and advantages sought therefor. It will be apparent to those skilled in the art, however, that many changes, modifications, variations and other uses and applications of the subject control system and method are possible and contemplated. All such changes, modifications, variations and other uses and applications which do not depart from the spirit and scope of the invention are deemed to be covered by the invention which is limited only by the claims which follow.

What is claimed is:

1. A conditioning time control for controlling the pre-vend time conditioning of products in a multi-selection vendor having credit entry means, vend selection means actuatable to select a vend selection, each vend selection having a pre-established vend price associated therewith, and vend producing means for effecting delivery to a customer of a product associated with the selected vend selection when the credit entered is at least equal to the vend price for the selected vend selection, said conditioning time control including means to inhibit vending of the products associated with a particular vend selection for a period of time in order to permit pre-vend time conditioning of such products, conditioning selection means actuatable by authorized personnel for individually establishing particular vend selections to be inhibited, and reset means operable by authorized personnel, said inhibiting means being responsive to actuations of said conditioning selection means and to operation of said reset means to effect pre-vend time conditioning of the products associated with the vend selections established by actuation of the conditioning selection means, said inhibiting means effecting pre-vend time conditioning by inhibiting vending of such products for a period of time subsequent to operation of the reset means while permitting vending of products associated with other vend selections.

2. The conditioning time control of claim 1 including timing means responsive to operation of said reset means to generate a first output signal for said period of time subsequent to operation of said reset means and to produce a second output signal after the passage of said period of time.

3. The conditioning time control of claim 2 wherein said conditioning selection means includes a plurality of conditioning selection switches, each conditioning selection switch being associated with a vend selection, said conditioning selection switches being operatively connected, in parallel, between said timing means and said inhibiting means, said inhibiting means including a plurality of gate circuits, each of said conditioning selection switches being operatively connected to a respective gate circuit, actuation of a conditioning selection switch operatively communicating the output signals of said timing means to a respective gate circuit of said inhibiting means.

4. The conditioning time control of claim 3 wherein when said first output signal of said timing means is operatively communicated to a gate circuit said gate circuit is responsive thereto to prevent gating of a vend selection therethrough.

5. The conditioning time control of claim 3 wherein when said first output signal of said timing means is operatively communicated to a gate circuit said gate circuit is disabled thereby, and when said second output signal of said timing means is operatively communicated to said gate circuit said gate circuit is enabled thereby.

6. The conditioning time control of claim 5 wherein said inhibiting means includes means to enable individual gate circuits that are operatively connected to non-actuated conditioning selection switches.

7. The conditioning time control of claim 2 wherein said timing means includes means adjustable by authorized personnel to vary said period of time.

8. The conditioning time control of claim 1 including vend selection conditioning means, said vend selection conditioning means being responsive to actuations of said conditioning selection means and to operation of said reset means for controlling conditioning of vend selections.

9. The conditioning time control of claim 8 wherein said vend selection conditioning means includes a plurality of product conditioning means, each of said product conditioning means being associated with at least one vend selection, operation of said reset means effecting operation of the product conditioning control means associated with vend selections established by actuation of said conditioning selection means to condition the products associated with the particular vend selections so established.

10. The conditioning time control of claim 1 including timing means having a plurality of timers, said conditioning selection means including a plurality of conditioning selection switches, said inhibiting means including a plurality of gate circuits, each gate circuit being associated with a vend selection and being operatively connected to a timer of said timing means through a series connected conditioning selection switch of said conditioning selection means, said timers each being responsive to operation of said reset means to generate a first output signal for a respective pre-established period of time subsequent to operation of said reset means and to produce a second output signal after the passage of said respective pre-established period of time, actuation of each conditioning selection switch operatively communicating the output signals of the timers operatively connected to such switch to the gate circuit operatively connected to such switch.

11. The conditioning time control of claim 10 wherein when said first output signal of a timer is operatively communicated to a gate circuit said gate circuit is disabled thereby, and when said second output signal of said timer is operatively communicated to said gate circuit said gate circuit is enabled thereby.

12. The conditioning time control of claim 11 wherein said inhibiting means includes means to enable individual gate circuits that are operatively connected to non-actuated conditioning selection switches.

13. The conditioning time control of claim 10 wherein said timers include time interval determination means for establishing respective pre-established periods of time that differ from one another.

14. The conditioning time control of claim 13 wherein said time interval determination means includes means adjustable by authorized personnel to vary the respective pre-established periods of time.

15. The conditioning time control of claim 1 including means to individually indicate on the multi-selection vendor those products undergoing pre-vend time conditioning.

16. The conditioning time control of claim 1 wherein said inhibiting means includes processing means for controlling the operation of the multi-selection vendor, said conditioning selection means includes means operable by authorized personnel to enter and provide data pertaining to pre-vend conditioning of products to said processing means, and said reset means includes means operable by authorized personnel to provide a time interval reset signal to said processing means.

17. The conditioning time control of claim 16 wherein said processing means includes memory, arithmetic, and control means, said memory means having a plurality of addresses for storing data pertaining to pre-vend conditioning of products, said control means being responsive to said time interval reset signal to effect pre-vend conditioning, said processing means being programmed to operate in accordance with a preselected set of instructions to inhibit the vending of products associated with the particular vend selections established by actuations of said conditioning selection means until said period of time has expired.

18. The conditioning time control of claim 17 wherein, subsequent to determination of the vend selection selected, and prior to vending of the product associated with the vend selection selected, said preselected set of instructions includes the steps of:

(a) checking data pertaining to pre-vend conditioning of the product associated with the vend selection selected to determine if pre-vend conditioning is required for such products;

(b) cancelling the vend selection determined to have been selected if both pre-vend conditioning is required for products associated with such vend selection and said period of time has not expired.

19. The conditioning time control of claim 17 wherein at least some of the data stored in said memory means includes data establishing said period of time.

20. The conditioning time control of claim 19 wherein said data establishing said period of time is determined by operation of said means to enter and provide data pertaining to pre-vend conditioning of products to said processing means.

21. In a multi-selection vend control system having vend selection means operable to select different vends at the same or at different costs, means for depositing credit entries, and vend control means for initiating a vend delivery operation whenever the amount of credit entered at least equals the cost of a selected vend, the improvement comprising a conditioning time control for controlling the pre-vend time conditioning of the products in a multi-selection vendor, said conditioning time control including timing means for establishing a predetermined time interval for pre-vend conditioning of products, conditioning selection means actuatable by authorized personnel to establish vend selections to be subject to pre-vend conditioning, time interval reset means operable by authorized personnel to initiate said time interval, inhibiting means responsive to initiation of said time interval to inhibit for the duration of said time interval communication of vend selection information from the vend selection means to the vend control means for those vend selections established by actuation of said conditioning selection means.

22. The improvement in a multi-selection vend control system of claim 21 wherein said inhibiting means includes a plurality of gating circuits, each gating circuit corresponding to a vend selection and being connected to receive vend selection information in response to operation of the vend selection means, each gating circuit being disabled for the duration of said time interval when the vend selection to which it corresponds has been established as a vend selection subject to pre-vend time conditioning by actuation of said conditioning selection means.

23. The improvement in a multi-selection vend control system of claim 22 wherein said timing means is responsive to said time interval reset means to produce a time conditioning output signal for the duration of said time interval, said conditioning selection means including a plurality of coupling members connected to receive said output signal of said timing means, each of said coupling members having an activated state and a de-activated state, each said coupling member adapted when in its activated state to be capable of operatively communicating said time conditioning output signal of said timing means to a respective gating circuit and when in its de-activated state to prevent operative communication of said output signal to the respective gating circuit.

24. The improvement in a multi-selection vend control system of claim 23 wherein said coupling members are normally-open switches.

25. A micro-processor controlled vending control system for controlling pre-vend time conditioning of products in a multi-selection vendor having credit entry means, information entry means for entering information including vend selection information, each vend selection having a pre-established vend price associated therewith, and vend means for effecting delivery to a customer of a product associated with a selected vend selection, comprising processing means for controlling the operation of the multi-selection vendor, said processing means being programmed to respond to conditioning selection information and to time reset information entered from the information entry means to establish vend selections to be subjected to pre-vend time conditioning and to effect pre-vend time conditioning of products associated with the vend selections established by entry of conditioning selection information, said pre-vend time conditioning of such products being accomplished by inhibiting for the duration of a pre-vend time interval delivery of products associated with the vend selections established by entry of conditioning selection information, said inhibiting being controlled by the programmed operation of said processing means when in its vending mode of operation, said processing means being programmed when in its vending mode of operation to (a) respond to vend selection information entered from the information entry means;

(b) check to determine if pre-vend time conditioning is required for the vend selection made, including determining (i) if the vend selection made is subject to pre-vend time conditioning and (ii) if the pre-vend time interval for pre-vend time conditioning has not elapsed, and proceeding to step (c) if either of conditions (i) or (ii) is false and to step (e) if conditions (i) and (ii) are both true;

(c) respond to the vend selection made to effect and control the performance of vending operations consistent with the amount of credit entered;

(d) proceed to step (a);

(e) cancel the vend selection previously made;

(f) proceed to step (a).

26. The micro-processor controlled vending control system of claim 25 wherein step (c) includes the step of causing the vend means to effect delivery of the vend selection made if the amount of credit entered is at least equal to the price of such vend selection.

27. The micro-processor controlled vending control system of claim 26 wherein step (c) further includes the step of controlling the payback of credit entered in excess of the vend price of the vend selection made and delivered.

28. The micro-processor controlled vending system of claim 26 wherein in proceeding from step (b) to step (e) the step of causing the vend means to effect delivery of the vend selection made is bypassed.

29. The micro-processor controlled vending system of claim 25 wherein step (e) includes the step of establishing conditions to enable the vending system to be responsive to alternate vend selection information entered from the information entry means.

30. A method of operation of a vend control means for a multi-selection vending machine for controlling pre-vend time conditioning of products in the vending machine, the vend control means including means for entering credit information, means for selecting vend selections at established vend prices, vend delivery means for delivering products to a customer, and means to process signals produced during servicing and vending modes of operation and to control the performance of vending operations, said method including, first, during a service mode of operation, the step of responding to service inputs to establish vend selections that are subject to pre-vend time conditioning and to initiate a pre-vend conditioning time interval, and, secondly, during a vending mode of operation, the steps of:

(a) responding to vend selections to determine the vend selection made;

(b) checking to determine if pre-vend time conditioning is required for the vend selection made, including determining (i) if the vend selection made is subject to pre-vend time conditioning and (ii) if the pre-vend time interval for pre-vend time conditioning has not elapsed, and proceeding to step (c) if either of conditions (i) or (ii) is false; and to step (e) if conditions (i) and (ii) are both true;

(c) responding to the vend selection made to effect and control the performance of vending operations consistent with the amount of credit entered;

(d) proceeding to step (a);

(e) cancelling the vend selection previously made;

(f) proceeding to step (a).

* * * * *